US012420154B2

(12) United States Patent
Hutchins

(10) Patent No.: US 12,420,154 B2
(45) Date of Patent: Sep. 23, 2025

(54) GOLF CLUB SECUREMENT STRUCTURE

(71) Applicant: Matthew James Hutchins, Chicago, IL (US)

(72) Inventor: Matthew James Hutchins, Chicago, IL (US)

( * ) Notice: Subject to any disclaimer, the term of this patent is extended or adjusted under 35 U.S.C. 154(b) by 0 days.

(21) Appl. No.: 17/890,079

(22) Filed: Aug. 17, 2022

(65) Prior Publication Data

US 2024/0009528 A1 Jan. 11, 2024

Related U.S. Application Data

(63) Continuation of application No. 17/862,125, filed on Jul. 11, 2022.

(51) Int. Cl.
*A63B 55/40* (2015.01)
*A63B 55/60* (2015.01)

(52) U.S. Cl.
CPC ..... *A63B 55/40* (2015.10); *A63B 55/60* (2015.10); *A63B 2225/68* (2013.01)

(58) Field of Classification Search
CPC ..... A63B 55/40; A63B 2225/68; A63B 55/60
USPC ..... 206/315.6, 315.2, 315.3
See application file for complete search history.

(56) References Cited

U.S. PATENT DOCUMENTS

| | | | | | |
|---|---|---|---|---|---|
| 1,756,902 | A * | 4/1930 | Boyce | A63B 55/40 | 206/315.6 |
| 5,775,513 | A * | 7/1998 | Anthony | A63B 55/40 | 206/315.9 |
| 5,947,282 | A * | 9/1999 | Merrill | A63B 55/40 | 206/315.6 |
| 6,352,154 | B1 * | 3/2002 | Miura | A63B 55/40 | 206/315.6 |
| 2012/0255217 | A1 * | 10/2012 | O'Dell | A01K 97/08 | 43/26 |
| 2017/0296890 | A1 * | 10/2017 | Maguire | A63B 55/00 | |

* cited by examiner

*Primary Examiner* — Orlando E Aviles
*Assistant Examiner* — Sanjidul Islam
(74) *Attorney, Agent, or Firm* — Inovue Advisors, LLC

(57) ABSTRACT

A golf club securement assembly with a grip holder assembly and a club head assembly that includes a support member having a top end, a bottom end, and a club head engagement surface positioned between top end and the bottom end. At least one channel is positioned on the club head engagement surface that extends in a direction from the top end of the club head assembly to the bottom end of the club head assembly. A shaft securement assembly is attached to the bottom end of the club head assembly and the top end of the grip holder assembly.

14 Claims, 11 Drawing Sheets

GOLF CLUB SECUREMENT STRUCTURE

PRIORITY

This Application is a continuation of U.S. application Ser. No. 17/862,125, filed Jul. 11, 2022.

BACKGROUND OF THE INVENTION

There has been significant growth in the popularity of golf over the last several years. Corresponding to this growth has been ever increasing innovation directed at golf equipment. Every year, there are new versions of clubs and new balls that allow golfers to hit the ball longer, with more control, or both. There has also been increasing innovation around golf accessories, such as clothing, range finders, watches, and ball flight tracking systems. Interestingly, one area of golf innovation that has remained relatively static over the years is the golf bag.

Today's golf bags are no different in function than golf bags from 100 years ago. A golf bag is made of a tubular receptacle, which is open on one end and closed on the other. Clubs are inserted grip first through the open top end, and the club heads protrude therefrom. There may be various straps or handles that allow a golfer to carry the bag, and there may be external storage pockets that allow golfers to store equipment, such as balls, tees, and clothing. The size and the shape of golf bags may differ, but they operate materially in the same way. A problem exists, however, in that golf bags are used differently than they were one hundred years ago.

First, today's golfers travel more than the golfers of the past. Golf bags are subjected to wear and tear as they are baggage checked and transported by car, through an airport, or as cargo by ground or air. Accordingly, there has been a rise in the use of golf travel bags. A golf travel bag is essentially a suitcase for a golf bag. The golf bag is actually inserted into the travel bag, which purports to act as a protective barrier over the golf bag. The problem is that travel bags do not always work, and clubs are damaged in transit. Furthermore, it is inconvenient for a well-travelled golfer to have both a golf bag and travel bag. It would be worthwhile if one bag could provide the functions of both a course bag and a travel bag.

Second, golf bags are used differently on the course than they once were. In the past, golfer may carry their own clubs or have a caddie carry them. Now, there is a greater variety of transportation on golf courses. There are electric golf carts, bicycle carts, Segway® carts, to name a few. The standard configuration of a golf bag, a top loading, tubular structure is not efficient for those means of transportation due to the various positions golf bags are placed into when using them. Furthermore, the standard configuration does not always provide an efficient way for golfers to access, the ever-increasing number of accessories that they may employ on the golf course. Accordingly, what is needed is a golf bag that operates in a completely different manner than golf bag that has been used over the years.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not constrained to limitations that solve any or all disadvantages noted in any part of this disclosure.

In one embodiment, a golf bag is provided. A sidewall defines a space. The sidewall has two opposing sides, a top end, and a bottom end. An opening is defined in at least one of the opposing sides of the sidewall. The opening extends from the bottom end to the top end. The opening is adapted to receive golf clubs. A door is moveably attached to at least one of the opposing sides. The door moves from an open position in which the opening is exposed for the insertion of golf clubs to a closed position in which the opening is closed.

In one embodiment, a club securement assembly is adapted to secure golf clubs in a sideways orientation that are loaded through the opening. In one embodiment, a second opening is defined in the top end of the sidewall. In one embodiment, when the door is in the closed position, the door closes the opening defined in the top end of the sidewall. In one embodiment, when the door is in the closed position a base portion extends from the bottom end of the sidewall to an intermediate location between the top end and the bottom end; and a tip portion extends at an angle relative to the base portion from the intermediate location. In one embodiment, the door is rotatably attached to one of the opposing sides through at least one hinge. In one embodiment, the door comprises an interior side which faces into the space when the door is closed and an exterior side which faces away from the space when the door is closed, and the golf bag has at least one storage pocket on an interior side of the door. In one embodiment, at least one golf ball holder is on the interior side of the door. In one embodiment, the two opposing sides comprise a first side, a second side, and an arcuate portion connecting the first side and the second side. In one embodiment, the sidewall has a U-shaped cross-section. In one embodiment, a club securement assembly is positioned along the first side, the second side, and the arcuate portion. In one embodiment, the club securement assembly defines a space within which items may be stored. In one embodiment, the club securement assembly is side loading such that clubs can only be secured by the club securement assembly if shafts thereof are inserted into the club securement assembly from the side. In one embodiment, a base plate is detachably connected to the bottom side of the sidewall. In one embodiment, the base plate houses wheels that can be used to transport the golf bag over a surface. In one embodiment, the door is a single piece. In one embodiment, the door comprises a first section and a second section and the first section and the second section are each rotatably attached to the sidewall. In one embodiment, the door is rotatably attached to the sidewall. In one embodiment, at least one hinge is attached to the door and the sidewall; wherein the at least one hinge rotates around an axis of rotation that extends from the bottom side to the top side of the sidewall. In one embodiment, at least one storage container that is shaped and dimensioned to fit within a club securement assembly that defines a storage space within the sidewall.

BRIEF DESCRIPTION OF THE DRAWINGS

A more detailed understanding may be had from the following description, given by way of example in conjunction with the accompanying drawings wherein.

DETAILED DESCRIPTION

Figure 1A:
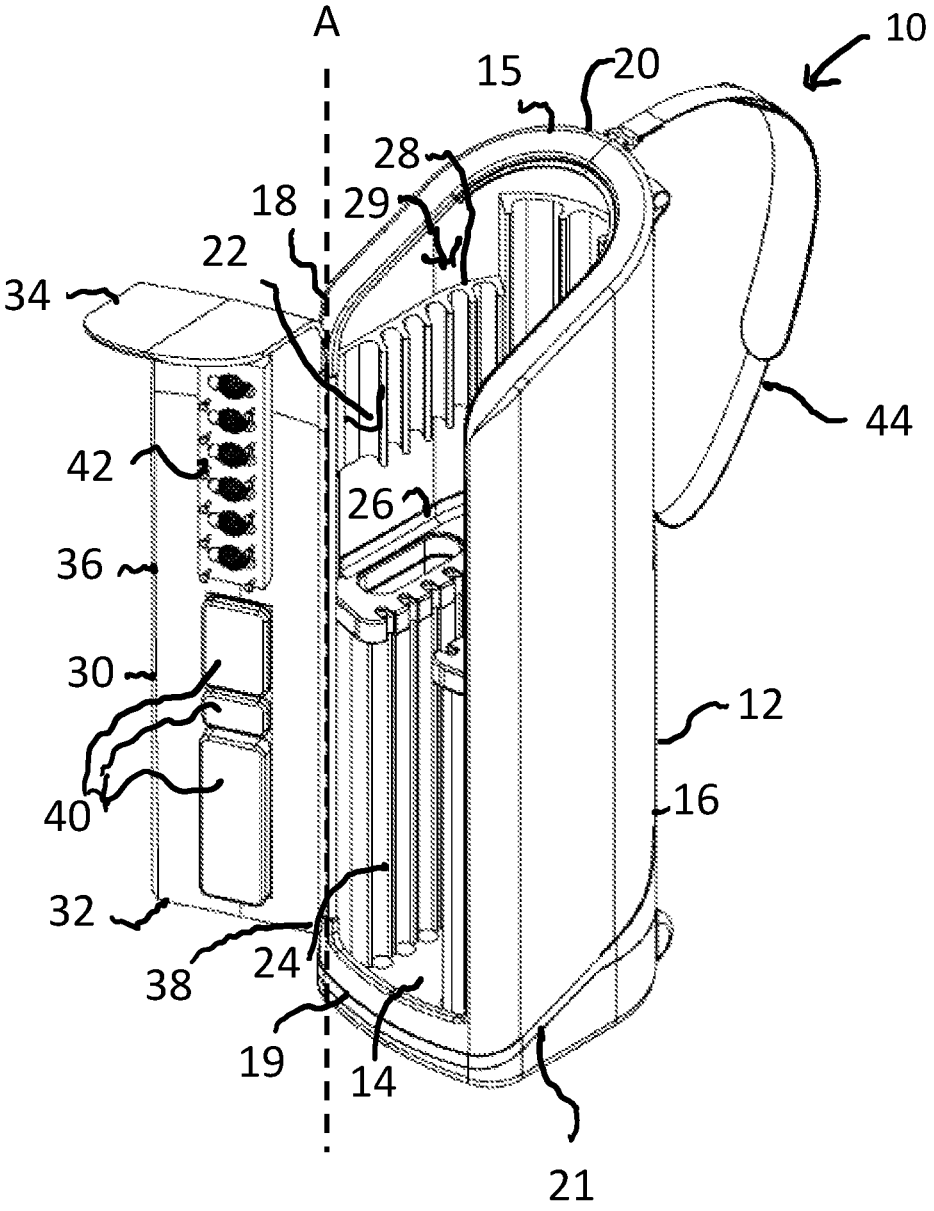
FIG. 1A is a perspective view of one embodiment of a golf bag with a cabinet opening and side loading club securement assembly.

Referring to FIG. 1A, a golf bag 10 is depicted. The term "golf bag" is typically used to refer to the container that is used to by a golfer to transport golf clubs around a golf course. "Travel bag" is often used to describe the bag that a golfer inserts a golf bag within when the golfer travels. It should be noted that the various embodiments and principles of the golf bag 10 that are described herein are not limited to a "golf bag" or "travel bag" per se but are applicable to all containers that are used to transport golf clubs. It is envisioned that golf bag 10 could be used as both a travel bag and a course bag. Furthermore, it should be noted that the various embodiments described herein are described with reference to golf clubs. However, some principles may be applicable to other types of equipment. For instance, the proprietary securement mechanisms could secure other items if dimensioned to fit within golf bag 10, or if the golf bag 10 were to be dimensioned to accommodate such items. Accordingly, the scope of the claims should not be limited to an intended use unless there are material and legally significant limitations recited therein that so limit the claims. Moreover, it should be noted that golf bag 10 is shaped and dimensioned in FIG. 1A to receive fifteen golf clubs, or 14 (regulation clubs and a ball retriever/training instrument (or other item fitting in this slot). However, golf bag 10 may be shaped and dimensioned to receive more or less than fifteen golf clubs without departing from the scope of the present disclosure. In addition, the shape of both the interior and exterior of golf bag 10 depicted in the drawings is not meant to limit the golf bag 10 to a particular shape or size. Accordingly, it is envisioned that other shapes and sizes are within the scope of the disclosure, and the claims should not be limited to the shape and size shown in the drawings unless specific limitations are set forth in the claims. Finally, when this disclosure refers to "golf clubs", it should be understood that such a reference could refer to a single golf club or multiple golf clubs unless the context makes it clear that it is referring to a "single" golf club or "multiple" golf clubs.

Referring further to FIG. 1A, golf bag 10 in one embodiment comprises a sidewall 12 defining an interior space 14. In one example, sidewall 12 is generally U-shaped and comprises a top end 15, a first side 16, a second side 18 opposite the first side 16, a front side 19, an arcuate section 20, opposite the front side 19, which connects the first side 16 and the second side 18, and a bottom end 21. Interior space 14 is located between the first section 16, the second section 18, the front side 19, and the arcuate section 20 and is shown having a generally U-shape. Arcuate section 20 generally defines the back side of the sidewall 12. Interior space 14 has a golf club securement assembly ("GCSA") 22 positioned within it. GCSA 22 comprises a grip holder assembly 24 for receiving the grip end of a club, a shaft securement assembly 26 which secures the shaft of a club, and a club head assembly 28 which receives a club head.

Referring further to FIG. 1A, sidewall 12 includes at least one opening 29 positioned on it. In one embodiment, opening 29 is positioned on front side 19 and provides access to interior space 14 through front side 19. In one embodiment, opening 29 extends upward through top end 15 and terminates at arcuate section 20. An opening 29 that extends upward through top end 15 provides a user visibility into interior space although the golf clubs are inserted and removed through front side 14. In one embodiment, opening 29 is substantially perpendicular to bottom end 21 on front side 19 and slopes gradually upward as it extends longitudinally along top end 15.

Referring further to FIG. 1A, golf bag 10 in one embodiment includes a door 30, which is rotatably mounted to sidewall 12. Door 30 in one embodiment includes a bottom end 32, a top end 34, a first lateral side 36 and a second opposing lateral side 38. Door 30 in one embodiment is rotatably mounted at its second lateral side 38 to the second side 18 of sidewall 12 such that door 30 rotates around an axis A. Accordingly, closing door involves rotating door in a counter-clockwise such that the first opposing lateral side 36 of door 30 abuts the first side 16 of sidewall. It should be noted that the configuration could be arranged such that the first lateral side 36 of door is attached to the first side 16 of sidewall 12 thereby causing the door to rotate around another axis (not shown) which extends parallel to first side 16 of sidewall 12. The door would then close by rotating it clockwise such that second lateral side 38 of door 30 would abut second side 18 of sidewall 12. It some instances, it may be desirable to make door 30 rotatably connected to both first side 16 and second side 18 of sidewall 12 such that it can move in both orientations. For instance, an electric or gas golf cart, often has two bags placed side-by-side. Accordingly, it may be worthwhile for one bag to open in one direction and another bag to open in the opposite direction. Regardless of orientation, the top side 34 of door 30 abuts the arcuate section 20 of sidewall 12 and the bottom side 32 of door 30 abuts sidewall 12 at its bottom end 21. In one example, door 30 includes one or more storage pockets 40 for holding accessories and one or more golf ball holders 42.

In an alternative embodiment, door 30 may open and close by moving laterally or longitudinally relative to sidewall 12 are also envisioned. For instance, door 30 in one example may comprise a sliding door positioned on front side 19 that is moveable relative to sidewall in a lateral direction, along a plane extending from first side 16 to second side 18, rather than a rotating around an axis. A sliding door could be made of one or more panels. A single panel could side relative to sidewall 12 and "wrap around" (interior or exterior) sidewall 12 as it is opened. Alternatively, multiple panels could be used that abut each other when closed and wrap around sidewall when open. As another alterative, door 30 may open and close by moving in a longitudinal direction. Door 30 could have one or more panels that may slide in the direction corresponding from bottom end 21 to top end 15 and vice versa. Accordingly, door may "roll up" or "roll down" to open and close it. Such a door 30 in one example may fold against itself in a "pancake" manner when it is opened.

In one embodiment, door 30 is shaped and dimensioned to match the shape of opening 29. Accordingly, when door 30 is closed, opening 29 is covered by door 30. When door 30 is open, opening 29 provides side access for items to be placed into sidewall 12. Therefore, unlike conventional, top loading golf bags, golf bag 10 provides a structure through which golf bags may be loaded through the front side 19.

In alternative embodiments, door 30 may be split into multiple portions such that one portion of door 30 may be open and one portion may be closed. For instance, door 30 could include a top section and a bottom section, or door could 30 comprises a "right" section rotatably attached to first side 16 of sidewall 12 and a "left" section rotatably attached to second side 18 of sidewall 12. Such configurations would provide partial access to the interior space 14 of golf bag. In the embodiment, shown in FIG. 1A, access to golf bag 10 is provided through front side 19. It should be noted, however, that other configurations are within the scope of this disclosure. For instance, access could be provided throughout sidewall 12, such as first side 16, second side 18, and/or arcuate section 20 by placing openings and/or doors on those sides. Moreover, opening 29 does not necessarily have to extend through top end 15. Opening 29 in one example may reside entirely on front side 19. GCSA 22, as will be further discussed herein, is a side loading securement mechanism. Accordingly, clubs are loaded through the portion of opening 29 that is on front side 19 and not through top end 15.

It should be noted that the material used to make golf bag 10 and the components therein may vary depending on a plurality of factors, including the style of the golf bag, its intended end user or use, and business or marketing considerations. Exemplary material for the sidewall 12 may include plastic, canvas, nylon, leather, or combinations thereof. There may be plastic, metal, and/or fabric reinforcing elements. In one example, sidewall 12 could be made of lightweight material for a carry bag, and heavier materials for a cart bag or a tour bag. Sidewall 12 could have a very functional appearance for one type of user and a luxury appearance for another type of user. It could have a hard shell, a soft shell, or a combination thereof. For instance, a combined golf bag/travel bag may have a hard plastic outer shell in its most protective formulation or a softer but rugged material (e.g., canvas) for a less protective formulation. It may have finishing elements, such as leather or a patterned experience to provide a bespoke appearance. Similarly, the materials used for interior components of golf bag 10 may vary for the same considerations.

Figure 1B:
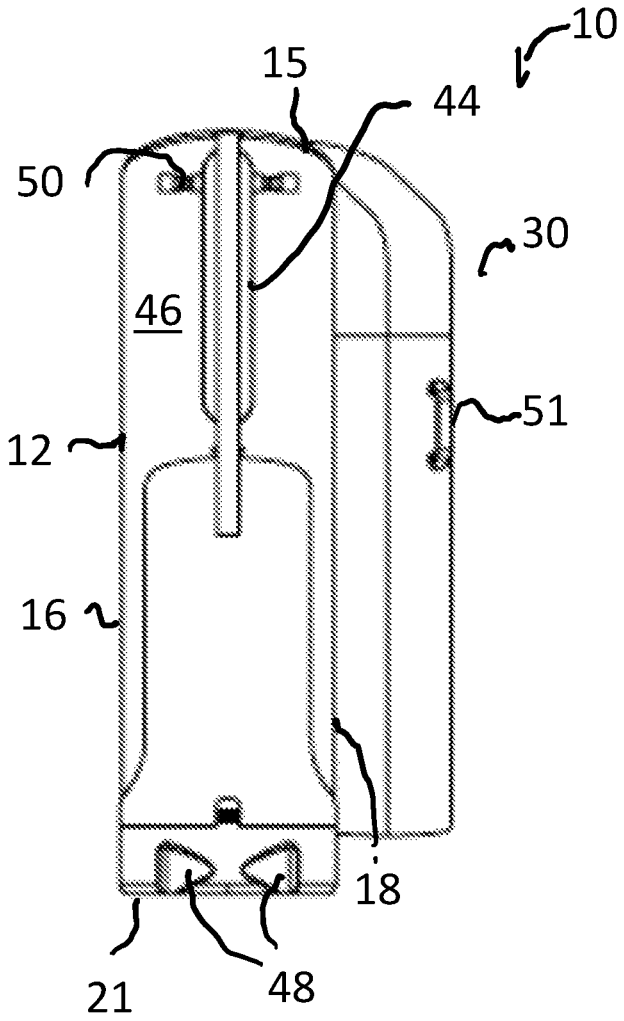
FIG. 1B is a rear view of the golf bag of FIG. 1A.
Figure 1C:
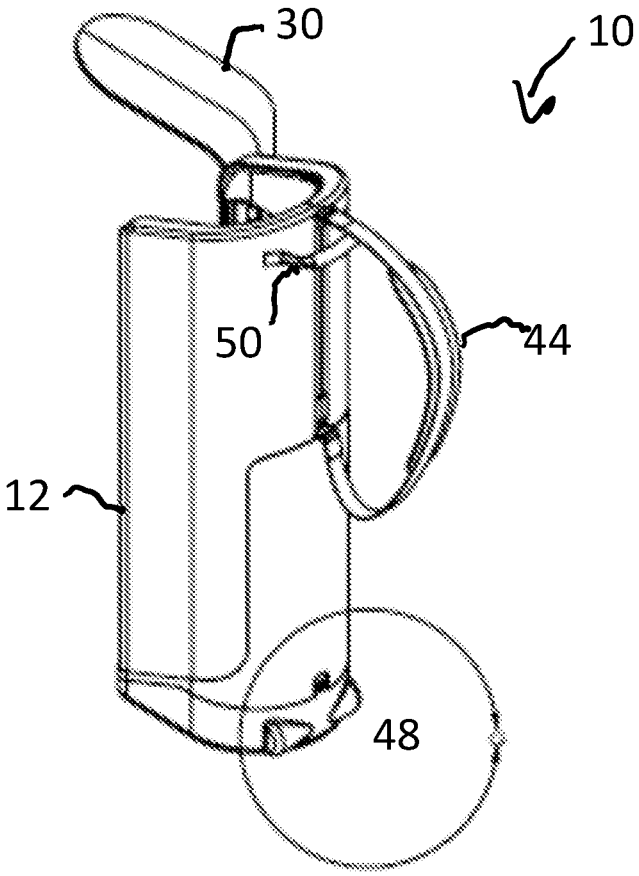
FIG. 1C is a perspective view of the back left side of the golf bag of FIG. 1A.
Figure 1D:
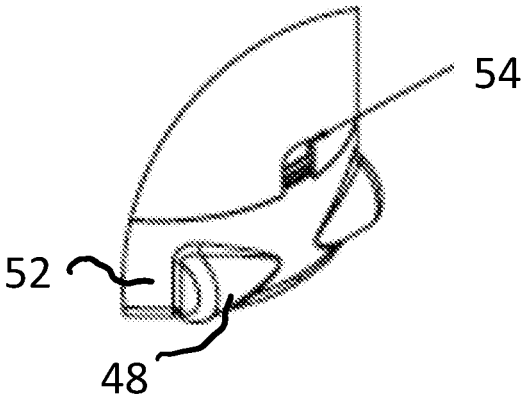
FIG. 1D is an enlarged view of a portion of the back left side of the golf bag of FIG. 1C.

Referring now to FIGS. 1A-1C, a carry strap 44 may be secured to the back side 46 of golf bag 10 to allow a user to carry the golf bag on the course or while in transport. In one embodiment a sleeve may be provided to allow golf bag 10 to be attached to a golf cart. That is the golf cart retaining straps can be looped through the sleeve, rather than around golf bag 10, to attach it to cart. In one embodiment, golf bag 10 includes wheels 48 located at the bottom end 21 of back side 46 of sidewall 12 and a handle 50 at the top end 15 of the back side 46 of sidewall 12. To pull golf bag 10, a user grasps handle 50 and rotates golf bag 10 groundward such that wheels 48 engage a surface. The user then pulls golf bag 10 over the surface. There may be a handle 51 on the front surface of door 30 to assist in opening and closing door 30. In one example, golf bag 10 includes a base plate 52 that is detachably connected to sidewall 12. Base plate 42 in one example houses wheels 48. When a golfer does not want to use the wheels 48, the golfer can disconnect the base plate 52 from the sidewall 12 by actuating a securement mechanism 54. Examples of securement mechanism 54 may be detachable connection mechanisms, such as hinges, friction fitting, hooks and tabs, rotational coupling, and the like. The securement mechanism 54 used to connect base plate 52 to sidewall 12 may include an interface on sidewall 12 that allows golf bag to be connected to other equipment, such as a golf cart.

Figure 2A:
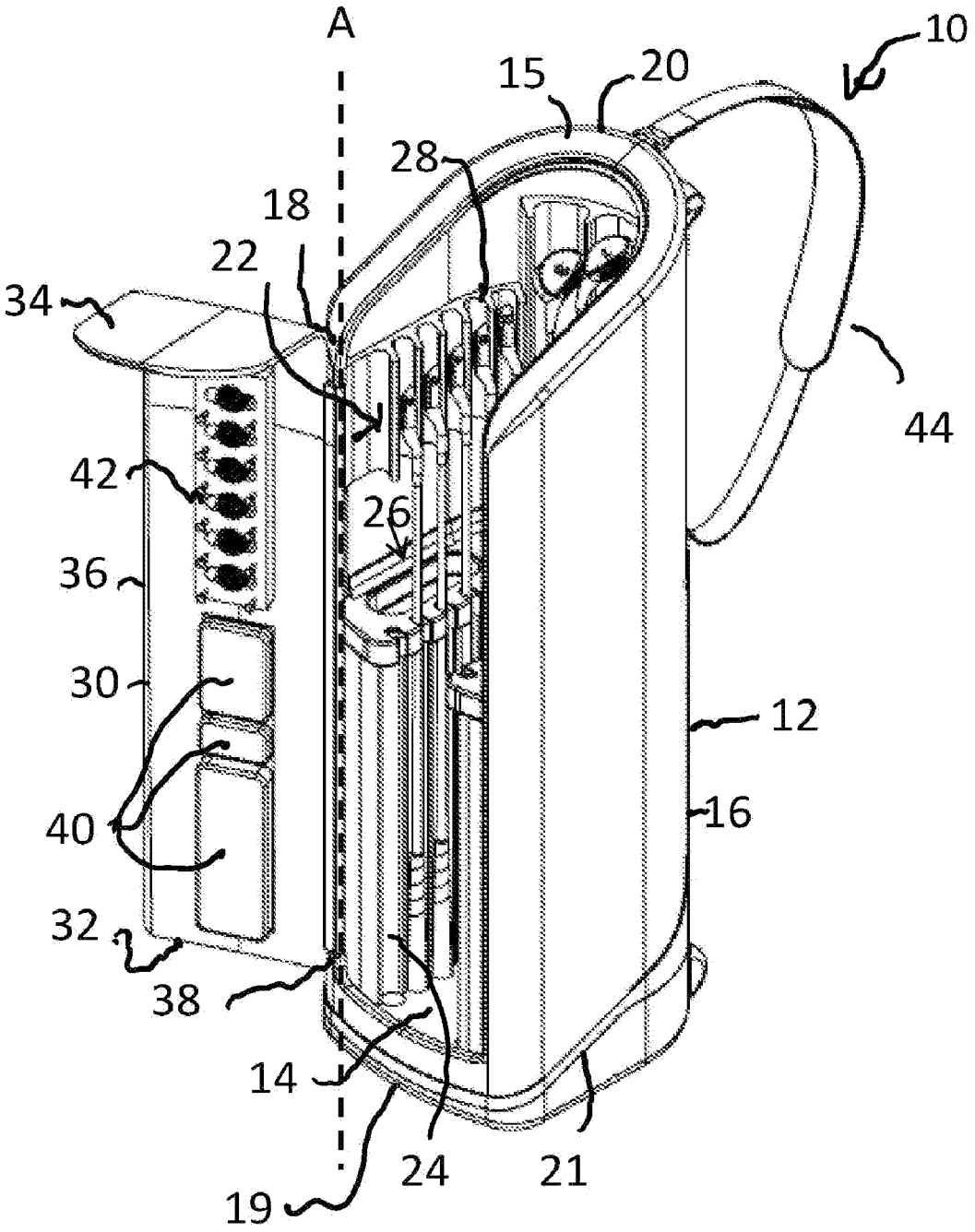
FIG. 2A is a perspective view of the golf bag of FIG. 1A with golf clubs positioned inside.
Figure 2B:
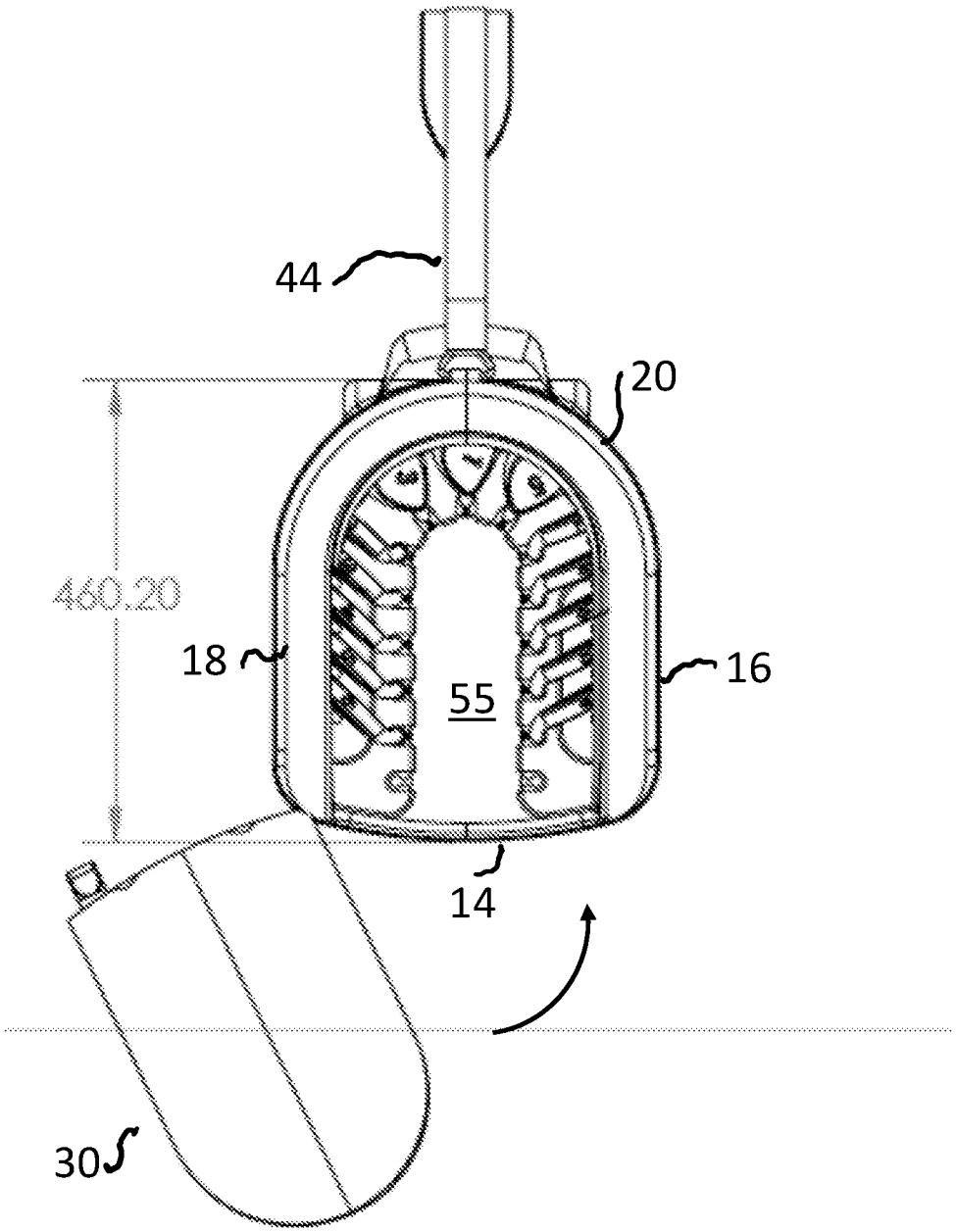
FIG. 2B is a top view of the golf bag of FIG. 2A with golf clubs shown inside.
Figure 2C:
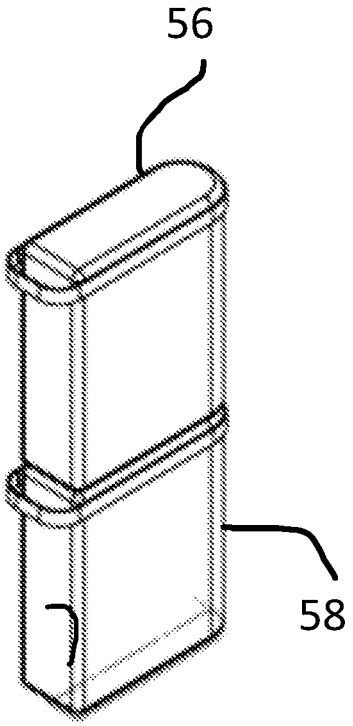
FIG. 2C is a perspective view of a plurality of storage containers shaped and dimensioned for insertion in the golf bag of FIG. 1A.
Figure 2D:
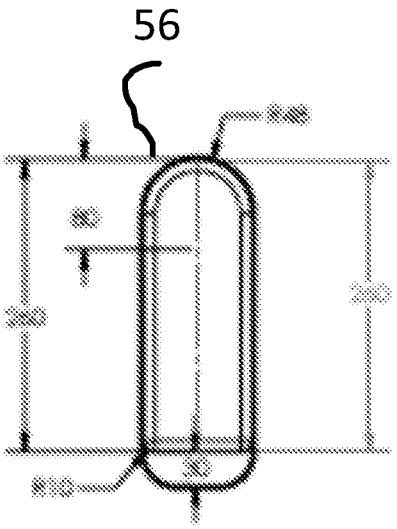
FIG. 2D is top of one of the storage containers depicted in FIG. 2C.

Referring to FIGS. 2A-2B, a perspective view and a top view of golf bag 10 are depicted to show an exemplary club layout. In the embodiment shown, door 30 moves in the direction of the arrow to close golf bag. In the embodiment shown, thirteen golf clubs are shown installed within the golf bag 10. There are three woods and ten irons. The woods are positioned around arcuate section 20 and the irons are in two groupings, one along first side 16 of sidewall 12 and one along second side 18 of sidewall 12. The configuration shown in FIG. 2B is provided for illustrative purposes only and should not limit the claims unless specific limitations are provided therein, which limit the claims. Other club configurations are encompassed by this disclosure. One additional function of the configuration shown in FIG. 2B is that there is useable space 55 positioned between the clubs and the front side 19 of sidewall 12. Space 55 could be used to store additional items. For instance, if bag 10 were used as a travel bag, space 55 could be used to store clothing or other items when bag is in transit. The items could be removed when the bag 10 is being used on the course. Furthermore, storage containers could be shaped and dimensioned to fit into space 55 and could be used to hold items during travel. FIG. 2C is a perspective view of a first container 56 and a second container 58 that are stackable relative to each other and are shaped and dimensioned to fit within space 55. FIG. 2D is top view of container 56.

Figure 3:
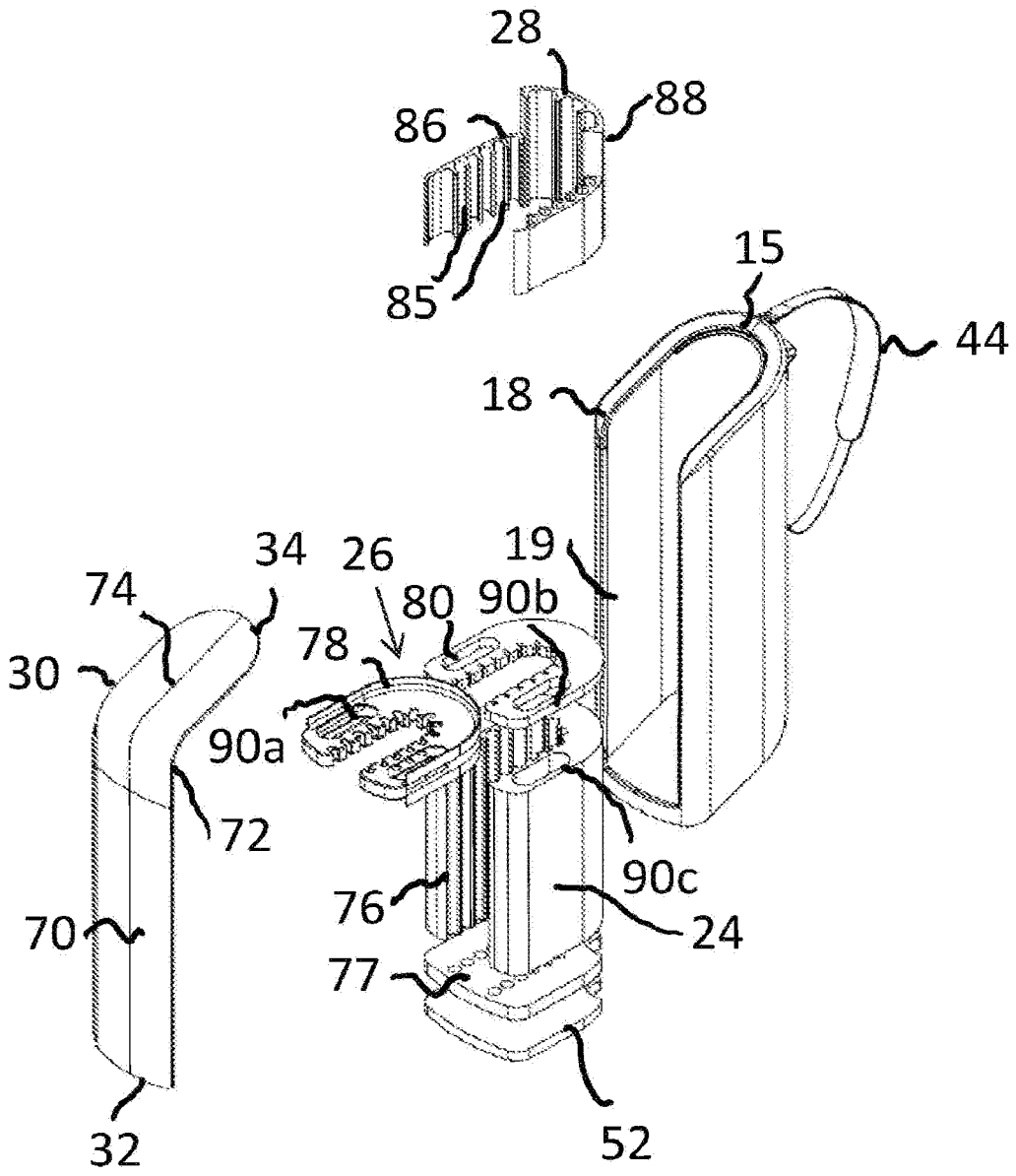
FIG. 3 is an exploded view of the golf bag of FIG. 1A.

Referring to FIG. 3, an exploded view of golf bag 10 is shown for illustrative purposes. In one embodiment, door 30 has a base portion 70 that extends from bottom end 32 upward toward top end 34 until it reaches bend 72. At bend 72, the door 30 bends such that it defines a tip portion 74 which extends at an angle from bend 72 to top end 34. Tip portion 74 serves to enclose interior space 14 at the top end 15 of sidewall 12. Base portion 70 encloses interior space 14 from the front side 19 of sidewall 30.

Referring further to FIG. 3, grip holder assembly 24 in one embodiment includes a plurality of channels 76 which are adapted to receive the grips of golf clubs when the golf clubs are inserted within bag 10. The grip end of a club rests in a channel 76. In one embodiment, a plate 77 is provided that includes a plurality of recesses which are positioned at the end of each respective channel 76. The recesses provide a place to rest the end of a club and prevent the clubs from shifting.

Referring further to FIG. 3, shaft securement assembly 26 in one embodiment comprises a top plate 78 and a bottom plate 80 that are connected in a pancake-like fashion. In an alternative embodiment, securement mechanism 54 may be made from a one-piece molded construction. Shaft securement assembly 26 secures the golf club shaft within sidewall 12, as will be further discussed herein.

Referring further to FIG. 3, GCSA 22 includes club head assembly 28. Club head assembly 28 in one example includes a plurality of channels 85 that are shaped and dimensioned to receive the various club heads in a user's bag. For instance, channels 86 are shaped and dimensioned to receive woods and channels 88 are shaped and dimensioned to receive various irons. Club head channel assembly 28 serves to separate club heads and prevent them from contacting each other.

Referring further to FIG. 3, in one embodiment top plate 78, bottom plate 80, and grip holder 24 include recesses 90*a*, 90*b*, and 90*c*. Recesses 90*a*, 90*b*, and 90*c* cooperate to form storage spaces, which can be used for storage of accessories, such as umbrellas, which will be further discussed herein.

It should be noted that the material used to make GCSA 22 may be different for each component. Club head channel assembly 28 may be made of a resilient material, such as injection molded plastic, with a softer overlay such as foam, in which the channels 85 are formed. In another example, club head channel assembly 28 may be formed from a single material, such as plastic or foam. In one embodiment, shaft securement assembly 26 may be made partially of a resilient plastic material and partially of metal. In one embodiment, shaft securement assembly 26 may comprise one material. In one embodiment, grip holder assembly 24 may comprise a resilient material, such as plastic with an overlay made of a slick material such that friction is reduced as grips are inserted into grip channels 76. In one embodiment, the elements of GCSA 22, are removeable from sidewall 12 for cleaning or maintenance. One or more of the components of GCSA 22 may be removably connected together as part of a modular construction. For instance, if one wanted to clean a part of GCSA 22, the component(s) in question could be detached and removed from sidewall, cleaned, and then reconnected to the other components of GCSA 22.

Figure 4A:
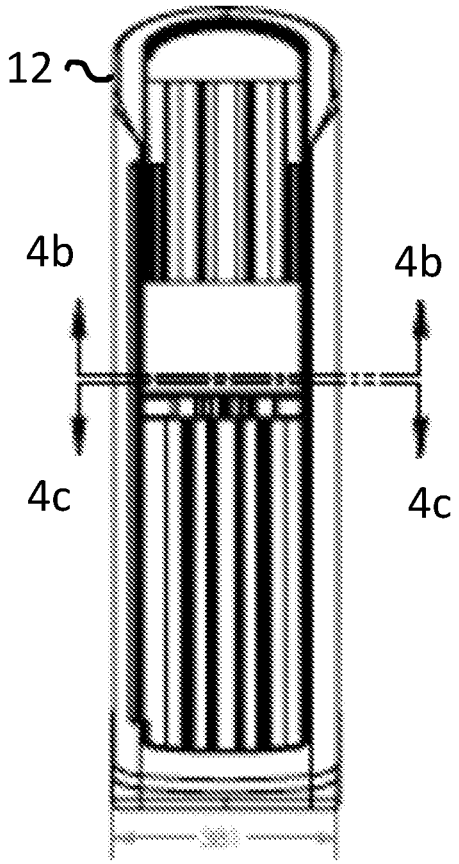
FIG. 4A is a front view of the golf bag of FIG. 4A with the door removed.

Referring now to FIG. 4A, a front view of sidewall 12 is shown for illustrative purposes. Front view of sidewall includes lines 4*b*-4*b* and 4*c*-4*c*, from which the sectional views of FIG. 4B and FIG. 4C are taken.

Figure 4B:
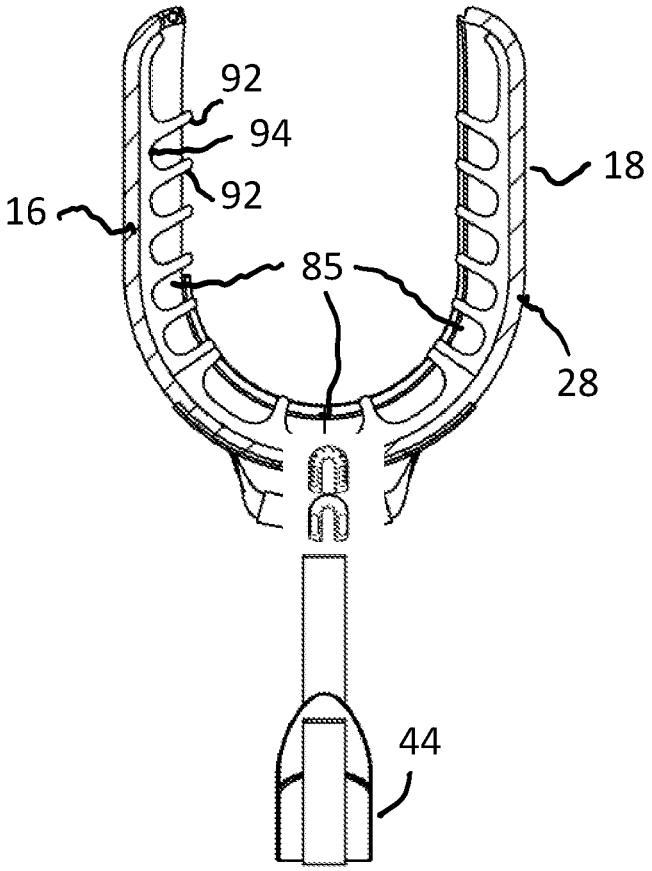
FIG. 4B is sectional view taken from FIG. 4A.

Referring to FIG. 4B, a sectional view taken along line 4*b*-4*b* of FIG. 4A is provided in which an observer is looking up the interior 14 of sidewall 12 in the direction of club head assembly 28. Club head assembly 28 includes channels 85. The channels 85 in one example are U shaped and include opposing finger portions 92 and arcuate portions 94 connecting the finger portions 92. In one example, the channel 85 extend upward from interior space 14 and toward the top end 15 of sidewall 12. The dimensions of channels 85 vary and are shaped and dimensioned for the club type for which they are intended. In one embodiment, club head assembly 28 may be made from a soft flexible material, such as foam, which can adapt to the size of the club pressed into it. This may be useful for users who want to use clubs that are not used as frequently as others, such as 7 woods or hybrids.

Figure 4C:
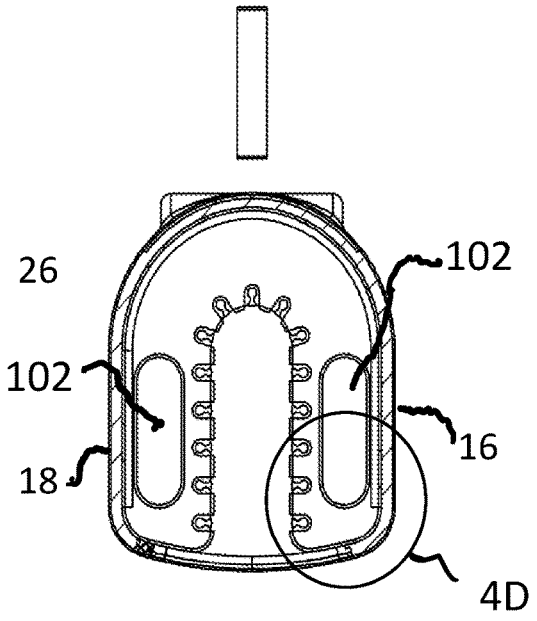
FIG. 4C is a section view taken from FIG. 4A.
Figure 4D:
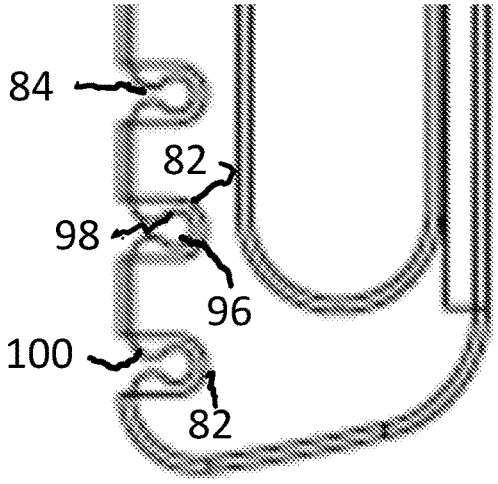
FIG. 4D is an enlarged view of a portion of FIG. 4C.
Figure 5A:
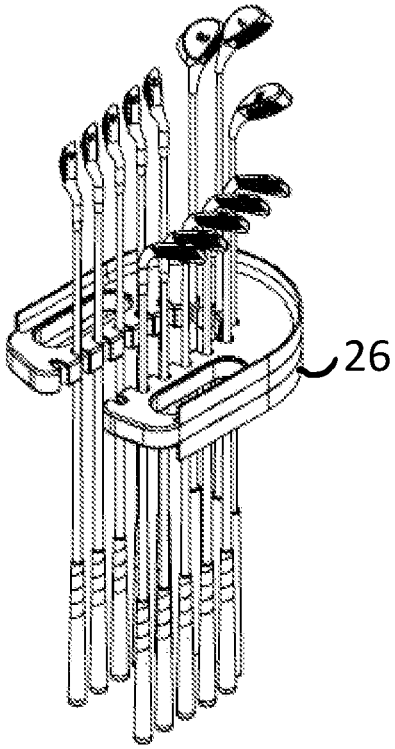
FIG. 5A is a perspective view of a portion of the club securement assembly shown in FIG. 1A with golf clubs secured therein.
Figure 5B:
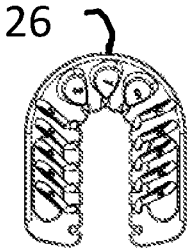
FIG. 5B is top view of the portion of the club securement assembly shown in FIG. 5A with golf clubs secured therein.

Referring to FIGS. 4C-4D, a sectional view taken along line 4*c*-4*c* of FIG. 4A in which an observer is looking down the interior of sidewall 12 in the direction of shaft securement assembly 26. In one embodiment, the top plate 78 (FIG. 3) of the shaft securement assembly 26 includes a plurality of alignment channels 82, which help a user guide the shaft of a golf club into securement mechanism 54. In one embodiment, an alignment channel is a U-shaped recess positioned on top plate 78. Each alignment channel 82 has a securement mechanism 84 centered therein. Securement mechanisms 84 in one example are positioned on bottom plate 80 (FIG. 3). Bottom plate 78 and top plate 80 are positioned relative to each other such that alignment channels 82 are in registration with securement mechanisms 84. In one example, securement mechanism 84 comprises a recess positioned on bottom plate 80. A recess includes a substantially circular head portion 96 which terminates at a neck 98 and a body portion 100 that tapers outward. The user inserts a club shaft through the body portion 100 until meeting resistance at the neck 98. The user then uses additional force to push the shaft until it snaps into place in the head portion 96. FIG. 5A depicts the shaft securement assembly 26 with clubs snapped in place along the shaft. FIG. 5B depicts a top view of the same. In this manner, clubs may be inserted and secured into the golf bag 10 from the front side 19 of the sidewall 10. Accordingly, golf bag 10 is side loading in contrast to top loading conventional bags.

Referring now to FIG. 4C, storage compartments 102, which were discussed earlier in connection with FIG. 3 are also depicted. These run from the interior space 14 to the bottom end 21 of sidewall 12 and can be used to store accessories, such as umbrellas, balls, clothing, training aids, ball retrievers, and the like.

In describing preferred examples of the subject matter of the present disclosure, as illustrated in the Figures, specific terminology is employed for the sake of clarity. The claimed subject matter, however, is not intended to be limited to the specific terminology so selected, and it is to be understood that each specific element includes all technical equivalents that operate in a similar manner to accomplish a similar purpose.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A golf club securement assembly for a golf bag, comprising:

a club head assembly comprising a support member having a top end, a bottom end, and a club head engagement surface positioned between the top end and the bottom end;

at least one channel on the club head engagement surface that extends in a direction from the top end of the club head assembly to the bottom end of the club head assembly, wherein the at least one channel is adapted to receive a golf club head;

a grip holder assembly, comprised of a continuous arcuate sidewall, and having a top end, a bottom end, and a grip holder engagement surface positioned between the top end and the bottom end of the grip holder assembly, wherein the grip holder engagement surface includes at least one channel extending from the top end to the bottom end of the grip holder assembly; and a shaft securement assembly, comprising a top plate and a bottom plate that are attached together in a pancaked fashion, attached to the bottom end of the club head assembly and the top end of the grip holder assembly; wherein the top plate includes at least one alignment channel, and the bottom plate includes at least one securement mechanism, in registration with the at least on alignment channel, such that the shaft securement assembly is adapted to removably attach a golf club shaft to the golf club securement assembly, and further wherein the at least one alignment channel, the at least one securement mechanism, and the at least one channel of the grip holder assembly are in registration with each other.

2. The golf club securement assembly of claim 1, wherein the support member is made of a soft flexible material.

3. The golf club securement assembly of claim 2, wherein the soft flexible material is foam.

4. The golf club securement assembly of claim 1, wherein the at least one channel on the club head engagement surface comprises a finger portion, another finger portion, and an arcuate portion connecting the finger portion and the other finger portion.

5. The golf club securement assembly of claim 4, wherein the finger portion, the other finger portion, and the arcuate portion have a U-shaped cross-section.

6. The golf club securement assembly of claim 5, wherein the at least one channel on the club head engagement surface extends from the top end of the club head assembly to the bottom end of the club head assembly.

7. The golf bag securement assembly of claim 1, wherein the at least one channel on the club head engagement surface comprises a plurality of channels.

8. The golf club securement assembly of claim 7, wherein the plurality of channels comprise:

a first channel that is shaped and dimensioned to receive a first club head; and a second channel that is shaped and dimensioned to receive a second club head; wherein the first channel and the second channel have different dimensions.

9. A golf club securement assembly for a golf bag, comprising:

a club head assembly adapted to receive a golf club head and hold the golf club head in a fixed position;

a grip holder assembly, comprised of a continuous arcuate sidewall, and having a top end, a bottom end, and a grip holder engagement surface positioned between the top end and the bottom end, wherein the grip holder engagement surface includes at least one channel extending from the top end to the bottom end; and a shaft securement assembly, comprising a top plate and a bottom plate that are attached together in a pancaked fashion, attached to a bottom end of the club head assembly and the top end of the grip holder assembly; wherein the top plate includes at least one alignment channel and the bottom plate includes at least one securement mechanism, in registration with the at least one alignment channel such that the shaft securement assembly is adapted to removably attach a golf club shaft to the golf club securement assembly, and further wherein the at least one alignment channel, the at least one securement mechanism, and the at least one channel of the grip holder assembly are in registration with each other.

10. The golf club securement assembly of claim 9, wherein the top plate includes a plurality of U-shaped recesses.

11. The golf club securement assembly of claim 10, wherein the bottom plate includes a plurality of securement mechanisms, wherein each of the plurality of securement mechanisms are placed in registration with a respective one of the U-shaped recesses.

12. The golf club securement assembly of claim 11, wherein at least one of the plurality of securement mechanisms comprises: a circular head portion, a tapered body portion, and a neck portion connecting the circular head portion and the tapered body portion.

13. The golf club securement assembly of claim 12, wherein the circular head portion is shaped and dimensioned to receive a golf club shaft and removably connect the golf club shaft to the golf club securement assembly.

14. The golf club securement assembly of claim 9, wherein the top plate and the bottom plate are formed integrally together.

* * * * *